US012345276B2

(12) United States Patent
Zhang et al.

(10) Patent No.: US 12,345,276 B2
(45) Date of Patent: Jul. 1, 2025

(54) CROSS-FLOW AIR DUCT AND AIR OUTLET DEVICE

(71) Applicant: GREE ELECTRIC APPLIANCES, INC. OF ZHUHAI, Zhuhai (CN)

(72) Inventors: Chi Zhang, Zhuhai (CN); Zhou Liu, Zhuhai (CN); Hao Liang, Zhuhai (CN); Wenlong Liang, Zhuhai (CN); Changjian Rao, Zhuhai (CN); Ling Tian, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 18/612,187

(22) Filed: Mar. 21, 2024

(65) Prior Publication Data

US 2024/0229823 A1 Jul. 11, 2024

Related U.S. Application Data

(63) Continuation of application No. PCT/CN2022/089930, filed on Apr. 28, 2022.

(30) Foreign Application Priority Data

Sep. 30, 2021 (CN) ..... 202111168578.4

(51) Int. Cl.
*F04D 29/42* (2006.01)
*F04D 17/00* (2006.01)
(Continued)

(52) U.S. Cl.
CPC ..... *F04D 29/4233* (2013.01); *F04D 17/00* (2013.01); *F04D 29/281* (2013.01);
(Continued)

(58) Field of Classification Search
CPC ..... F04D 29/4233; F24F 1/0025
See application file for complete search history.

(56) References Cited

U.S. PATENT DOCUMENTS

2017/0016453 A1 1/2017 Knopp et al.

FOREIGN PATENT DOCUMENTS

CN 202381398 U 8/2012
CN 203571893 U 4/2014
(Continued)

OTHER PUBLICATIONS

International Search Report issued in corresponding PCT Application No. PCT/CN2022/089930, dated Jul. 27, 2022.
(Continued)

*Primary Examiner* — Brian O Peters
(74) *Attorney, Agent, or Firm* — Westbridge IP LLC

(57) ABSTRACT

Disclosed are a cross-flow air duct and an air outlet device. The cross-flow air duct includes a volute and a volute tongue. The volute includes a first body, a first side of the first body is an air inlet side, and a second side of the first body is an air outlet side. The volute tongue includes a second body, a first side of the second body is an air inlet side, and a second side of the second body is an air outlet side. An air inlet port is formed between the first sides, and an air outlet port is formed between the second sides. According to the cross-flow air duct, multiple groups of air outlet areas in different directions are formed, the air outlet width is enlarged as a whole, and the air supply range is increased.

20 Claims, 10 Drawing Sheets

(51) Int. Cl.

| | |
|---|---|
| ***F04D 29/28*** | (2006.01) |
| ***F04D 29/44*** | (2006.01) |
| ***F04D 29/70*** | (2006.01) |
| ***F24F 1/0025*** | (2019.01) |

(52) U.S. Cl.
CPC ..... *F04D 29/441* (2013.01); *F04D 29/703* (2013.01); *F24F 1/0025* (2013.01)

(56) References Cited

FOREIGN PATENT DOCUMENTS

| | | | |
|---|---|---|---|
| CN | 106321473 | A | 1/2017 |
| CN | 206037363 | | 3/2017 |
| CN | 106594868 | A | 4/2017 |
| CN | 106958868 | A | 7/2017 |
| CN | 111594474 | A | 8/2020 |
| CN | 112177947 | A | 1/2021 |
| CN | 112524093 | A | 3/2021 |
| CN | 113719458 | A | 11/2021 |
| CN | 113738703 | A | 12/2021 |
| CN | 215908072 | U | 2/2022 |
| CN | 215908118 | U | 2/2022 |
| JP | H11201081 | A | 7/1999 |
| JP | 2004278473 | A | 10/2004 |
| JP | 2004293887 | A | 10/2004 |
| JP | 2018035745 | A | 3/2018 |
| WO | 2017101673 | A1 | 6/2017 |

OTHER PUBLICATIONS

Written Opinion issued in corresponding PCT Application No. PCT/CN2022/089930, dated Jul. 27, 2022.

First Office Action issued in counterpart Chinese Patent Application No. 202111168578.4, dated Dec. 18, 2024.

Notice of Reasons for Refusal issued in counterpart Japanese Patent Application No. JP 2024-519460, dated Mar. 4, 2025.

CROSS-FLOW AIR DUCT AND AIR OUTLET DEVICE

CROSS-REFERENCE TO RELATED APPLICATIONS

This application is a continuation of International Application No. PCT/CN2022/089930, filed on Apr. 28, 2022, which claims priority to Chinese Patent Application No. 202111168578.4, filed on Sep. 30, 2021. The disclosures of the aforementioned applications are hereby incorporated by reference in their entireties.

TECHNICAL FIELD

The present disclosure relates to a field of fan technology, and in particular to a cross-flow air duct and an air outlet device.

BACKGROUND

With the improvement of living standard, requirements of people on diversity of functions and performances of fans have also increased, and fans that can bring comfortable experience are more favored. At present, tower fans in the market are slender in appearance, small in occupied area, free of exposed blades and with a higher safety coefficient; a multi-blade cross-flow fan wheel of tower fans, in cooperation with a long-stroke air duct, contributes to achieve uniform air-cutting between up and down, resulting in good continuity of air supply. Due to limitations to a tower-shaped appearance and a smaller diameter of the fan wheel, a corresponding air outlet port is relatively narrowed, and a cross-flow air duct volute is mostly designed adopting an Archimedes spiral line or a logarithmic spiral line, causing that a fluid will be sent out along a tangential direction formed by the spiral line, an air pressure near a volute-shaped line is higher than an air pressure far away from the volute-shaped line, so there exists a difference in air speed between near the volute and far away from the volute of the air outlet port, that is, the air speeds on a left side and a right side of the air outlet port are not uniform, and since an air outlet area is limited, a range of air supply is narrow, so that temperature uniformity of a body surface of a user is poor.

SUMMARY

In view of this, a technical problem to be solved by the present disclosure is to overcome a defect that an air supply range of a cross-flow air duct in the related art is narrow, an therefore, the present disclosure provides a cross-flow air duct and an air outlet device which are capable of improving an air supply range.

Embodiments of the present disclosure provide a cross-flow air duct. The cross-flow air duct includes: a volute, including a first body, a first side of the first body being an air inlet side, and a second side of the first body being an air outlet side; and a volute tongue, arranged in a staggered manner with the volute, the volute tongue including a second body, a first side of the second body being an air inlet side, a second side of the second body being an air outlet side, a mounting space suitable for a fan wheel being formed between the first body and the second body, an air inlet port being formed between the first side of the first body and the first side of the second body, an air outlet port being formed between the second side of the first body and the second side of the second body; the air outlet port including a plurality of first air outlet openings and a plurality of second air outlet openings, and the first air outlet openings and the second air outlet openings being alternately arranged in a staggered manner along the axial direction of the volute.

A plurality of first air deflectors are arranged at intervals along the axial direction of the volute on the second side of the first body. Each first air outlet opening is formed between a corresponding first air deflector and the second body.

A plurality of second air deflectors are arranged at intervals along the axial direction of the volute in the second side of the second body. Each second air outlet opening is formed between a corresponding second air deflector and the first body. The first air deflector and the second air deflector are alternately arranged along the axial direction of the volute.

The first air deflector includes a first air deflector body and a first air guide surface disposed at the end of the first plate body and extending toward an outer side of the mounting space, a second side of the first body is further provided with a second air guide surface, and the second air guide surface extends toward an outer side of the mounting space.

The second air deflector includes a second plate body and a third air guide surface disposed at the end of the second plate body and extending toward an outer side of the mounting space, a second side of the second body is further provided with a fourth air guide surface, and the fourth air guide surface extends toward an outer side of the mounting space.

Defining a central symmetry plane of the first air guide surface and the second air guide surface as a first plane, defining a central symmetry plane of the third air guide surface and the fourth air guide surface as a second plane, an included angle between the first plane and the second plane is $\theta$, and $0<\theta\leq 40°$.

Defining a central symmetry plane between the second side of the first body and the second side of the second body as a dislocation reference plane, the first plane and the second plane are respectively located on two opposite sides of the dislocation reference plane, an included angle between the first plane and the dislocation reference plane is $\theta 1$, an included angle between the second plane and the dislocation reference surface is $\theta 2$, $0<\theta 1\leq 20°$ and/or $0<\theta 2\leq 20°$.

A plurality of third air deflectors are arranged at intervals along the axial direction of the volute on the first side of the first body.

An air inlet guiding surface is provided on the first side of the second body.

The cross-flow air duct further includes an air outlet grille arranged at the air outlet port, the air outlet grille includes a plurality of first grille sections and a plurality of second grille sections alternately arranged along the axial direction of the volute, the plurality of first grille sections are respectively arranged at the plurality of first air outlet openings, the plurality of second grille sections are respectively arranged at the plurality of second air outlet openings, a longitudinal central symmetry plane of each first grille section is close to the second side of the first body, and a longitudinal central symmetry plane of each second grille section is close to the second side of the second body.

Defining a longitudinal central symmetry plane of the first grille section as a first central symmetry plane, defining a longitudinal central symmetry plane of the second grille section as a second central symmetry plane, an included angle between the first central symmetry plane and the second central symmetry plane is $\beta$, and $0<\beta\leq 50°$.

Defining a central symmetry plane of the second side of the first body and the second side of the second body as a dislocation reference plane, an included angle between the first central symmetry plane and the dislocation reference plane is β1, an included angle between the second central symmetry plane and the dislocation reference plane is β2, $0<\beta1\leq25°$, and/or $0<\beta2\leq25°$.

The cross-flow air duct further includes a fan wheel disposed in the mounting space, and a diameter of the fan wheel is D.

A cross section of the second body is a circular arc, and an axis of the second body is collinear with an axis of the fan wheel.

A radial minimum distance between the second body and the fan wheel is A, and $1D/28\leq A\leq1D/10$.

A volute throat is provided at a position where a distance between the first body and the fan wheel is the smallest, the distance between the volute throat and the fan wheel is B, and $1D/22\leq B\leq1D/11$.

A length of each first grille section is C, and/or, a length of each second grille section is C. Herein, $1D/9\leq C\leq1D/4$.

A radial distance between the air outlet grille and the fan wheel is F, and $1D/6\leq F\leq1D/3$.

The fan wheel includes a plurality of fan wheel sections. A distance between any two adjacent first air deflectors, or any two adjacent second air guide plates, or any two adjacent first grille sections, or any two adjacent second grille sections is N times a length of one fan wheel sections, and $1\leq N\leq3$.

The present embodiment further provides an air outlet device, including the cross-flow air duct.

The technical solution of the present disclosure has the following advantages: according to the cross-flow air duct provided by the present disclosure, the air outlet port and the air inlet port are formed between the first body and the second body, and the air outlet port is distributed into the plurality of first air outlet openings and the plurality of second air outlet openings which are alternately arranged at intervals in the axial direction of the volute, and therefore, a plurality of groups of air outlet areas in different directions are formed; it could be defined that the side where the volute is located is the left side, and the side where the volute tongue is located is the right side, so that the left side of the first air outlet openings is more left relative to the left side of the second air outlet openings, and the right side of the second air outlet openings is more right relative to the right side of the first air outlet openings, such that the whole air outlet width is expanded, and the air supply range is enlarged.

BRIEF DESCRIPTION OF THE DRAWINGS

In order to more clearly illustrate the technical solutions in the specific embodiments of the present disclosure or in related technologies, the accompanying drawings that need to be used in the detailed description or related technical description will be briefly described below, and it is obvious that the drawings in the following description are some embodiments of the present disclosure, and as for a person having ordinary skill in the art, without any creative work, other drawings may be obtained according to these drawings.

DETAILED DESCRIPTION OF THE EMBODIMENTS

Figure 1:
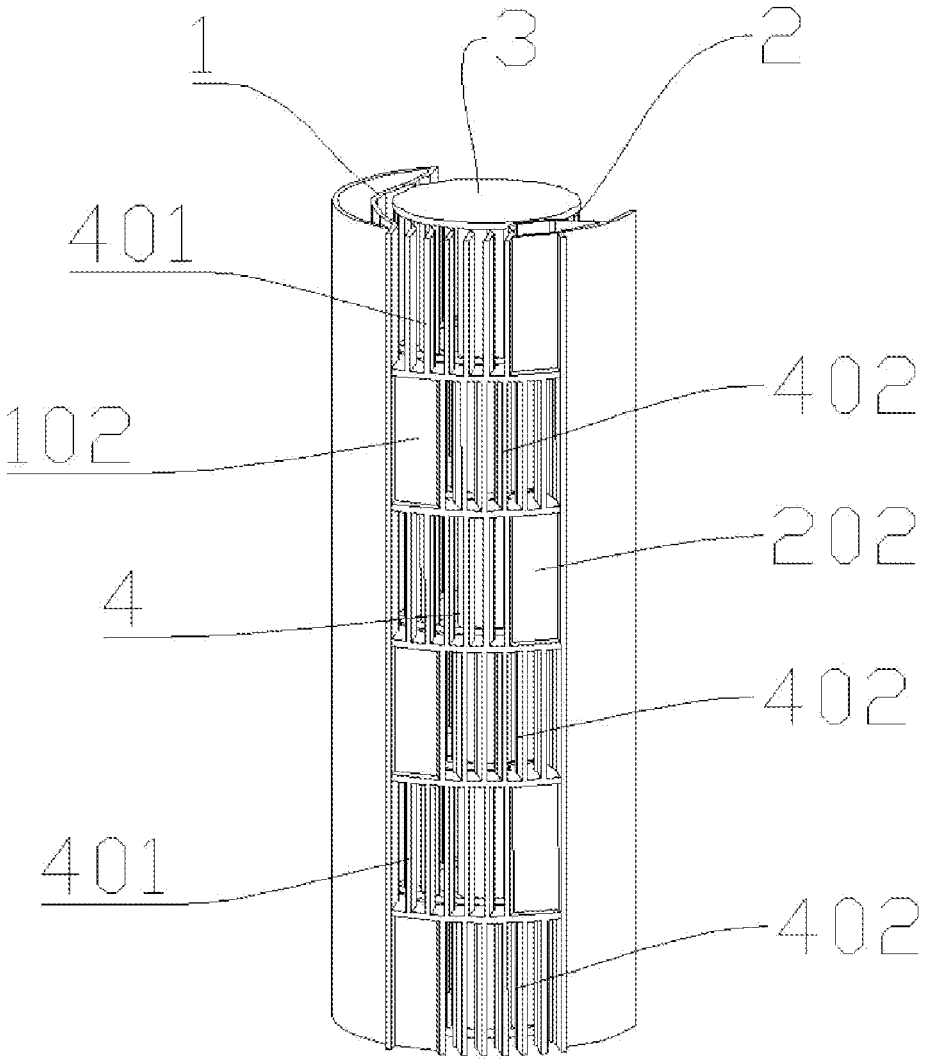
FIG. 1 is a schematic structural diagram of a cross-flow air duct provided in an embodiment of the present disclosure.

The technical solutions of the present disclosure will be clearly described below in combination with drawings. It is apparent that the described embodiments are not all embodiments but part of embodiments of the present disclosure.

In the descriptions of the present disclosure, it is to be noted that orientation or position relationships indicated by terms "center", "upper", "lower", "left", "right", "upright", "horizontal", "inner", "outer" and the like are orientation or position relationships shown in the drawings, are adopted not to indicate or imply that indicated devices or components must be in specific orientations or structured and operated in specific orientations but only to conveniently describe the present disclosure and simplify descriptions and thus should not be understood as limits to the present disclosure. In addition, terms "first", "second" and "third" are only adopted for description and should not be understood to indicate or imply relative importance.

In the description of the present disclosure, unless expressly specified and limited thereto, the terms "mounted", "connected" and "coupled" should be construed broadly, for example, may be a fixed connection, a detachable connection, or an integrated connection; may be a mechanical connection or an electrical connection; may be directly connected or indirectly connected by means of an intermediate medium, and may be an internal communication between two elements. For a person having ordinary skill in the art, the specific meaning of the above terms in the present disclosure may be understood specifically.

In addition, the technical features involved in the different embodiments of the present disclosure described below may be combined with each other as long as there is no conflict between each other.

With the improvement of living standard, requirements of people on diversity of functions and performances of fans have also increased, and fans that can bring comfortable experience are more favored. At present, tower fans in the market are slender in appearance, small in occupied area, free of exposed blades and with a higher safety coefficient; a multi-blade cross-flow fan wheel of tower fans, in cooperation with a long-stroke air duct, contributes to achieve uniform air-cutting between up and down, resulting in good continuity of air supply. Due to limitations to a tower-shaped appearance and a smaller diameter of the fan wheel, a corresponding air outlet port is relatively narrowed, and a cross-flow air duct volute is mostly designed adopting an Archimedes spiral line or a logarithmic spiral line, causing that a fluid will be sent out along a tangential direction formed by the spiral line, an air pressure near a volute-shaped line is higher than an air pressure far away from the volute-shaped line, so there exists a difference in air speed between near the volute and far away from the volute of the air outlet port, that is, the air speeds on a left side and a right side of the air outlet port are not uniform, and since an air outlet area is limited, a range of air supply is narrow, so that temperature uniformity of a body surface of a user is poor.

In view of this, referring to FIGS. 1 to 10, embodiments of the present disclosure provide a cross-flow air duct, which can enlarge the air supply range.

In an embodiment, the cross-flow air duct includes a volute 1 and a volute tongue 2. The volute 1 includes a first body 101. A first side of the first body 101 is an air inlet side, and a second side of the first body 101 is an air outlet side. The volute tongue 2 and the volute 1 are arranged at an interval. The volute tongue 2 includes a second body 201. A first side of the second body 201 is an air inlet side, and a second side of the second body 201 being an air outlet side. A mounting space suitable for mounting a fan wheel 3 is formed between the first body 101 and the second body 201. An air inlet port is formed between the first side of the first body 101 and the first side of the second body 201, and an air outlet port is formed between the second side of the first body 101 and the second side of the second body 201. The air outlet port includes a plurality of first air outlet openings and a plurality of second air outlet openings, and the plurality of first air outlet openings and the plurality of second air outlet openings are alternately arranged at intervals along an axial direction of the volute 1.

The air outlet port and the air inlet port are formed between the first body 101 and the second body 201, and the air outlet port is distributed into the plurality of first air outlet openings and the plurality of second air outlet openings which are alternately arranged at intervals in the axial direction of the volute 1, and therefore, a plurality of groups of air outlet areas in different directions are formed. A plurality of first air deflectors 102 are arranged at intervals along the axial direction of the volute 1 in the second side of the first body 101, the first air outlet openings are formed between the first air deflectors 102 and the second body 201; a plurality of second air deflectors 202 are arranged at an interval along an axial direction of the volute 1 in the second side of the second body 201, the second air outlet openings are formed between the second air deflectors 202 and the first body 101; and the first air deflectors 102 and the second air deflectors 202 are alternately arranged along the axial direction of the volute 1. It can be defined that the side where the volute 1 is located is the left side, and the side where the volute tongue 2 is located is the right side, so that the left side of the first air outlet openings is more left relative to the left side of the second air outlet openings, and the right side of the second air outlet openings is more right relative to the right side of the first air outlet openings, such that the whole air outlet width is expanded, and the air supply range is enlarged.

On the basis of the above embodiment, in some embodiments, each first air deflector 102 comprises a first plate body 1021 and a first air guide surface 1022, the first air guide surface 1022 is disposed at an end of the first plate body 1021 and extends toward an outer side of the mounting space. The second side of the plate body 101 is further provided with a second air guide surface 103, and the second air guide surface 103 extends toward the outer side of the mounting space. Each second air deflector 202 comprises a second plate body 2021 and a third air guide surface 2022, the third air guide surface 2022 is disposed at the end of the second plate body 2021 and extends toward the outer side of the mounting space. The second side of the second body 201 is further provided with a fourth air guide surface 203, and the fourth air guide surface 203 extends toward the outer side of the mounting space. In this embodiment, the configuration of the first air guide surface 1022, the second air guide surface 103, the third air guide surface 2022, and the fourth air guide surface 203 can guide the air outlet direction to ensure that the air blows towards the outer side, thereby avoiding airflow turbulence at the air outlet port. In an alternative embodiment, an end surface of the first plate body 1021, an end surface of the second plate body 2021, the second side of the first body 101, and the second side of the second body 201 may be respectively provided with a guiding inclined surfaces, and the air outlet direction can be guided by guiding the inclined surfaces.

In a specific embodiment, the first air guide surface 1022, the second air guide surface 103, the third air guide surface 2022, and the fourth air guide surface 203 respectively extend outward along the radial direction of the wind wheel 3.

Figure 10:
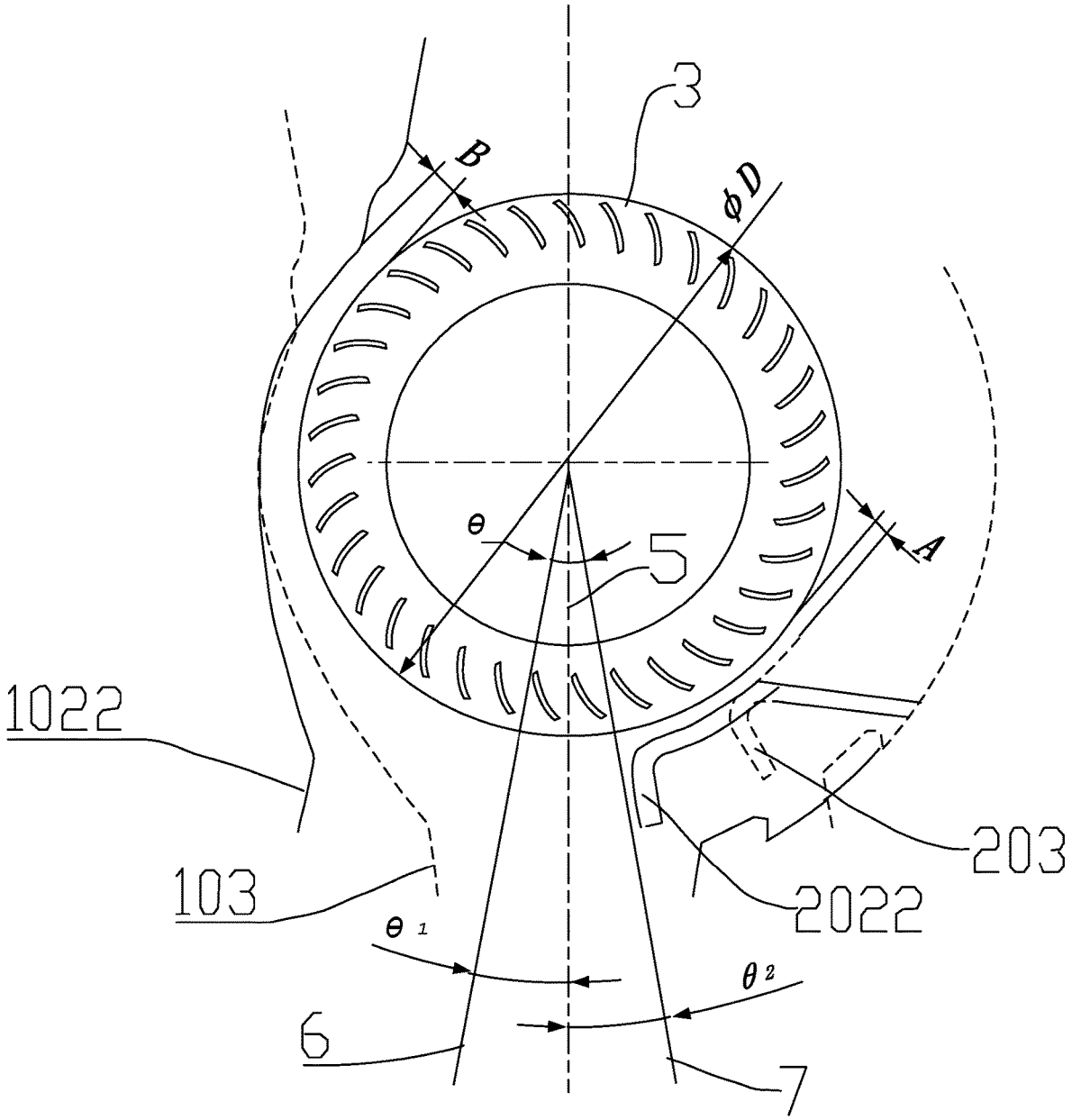
FIG. 10 is a top view of the cross-flow air duct shown in FIG. 4.

On the basis of the above embodiments, in some embodiments, as shown in FIG. 10, a central symmetry plane of the first air guide surface 1022 and the second air guide surface 103 is defined as a first plane 6, a central symmetry plane of the third air guide surface 2022 and the fourth air guide surface 203 is defined as a second plane 7, an included angle between the first plane 6 and the second plane 7 is $\theta$, and $0<\theta\leq 40°$. In this embodiment, the included angle between the first plane 6 and the second plane 7 is also a misalignment angle between the first air outlet area and the second air outlet area. According to the embodiment, by limiting the dislocation angle between the first air outlet area and the second air outlet area, the situation that the airflow speed and the pressure distribution in the cross-flow air duct are not uniform due to the fact that the dislocation angle is too large can be avoided. The uneven airflow acting on the volute tongue 2, the volute 1 and the wind wheel 3 will form pulsation of airflow pressure along with time. Airflow pulsation caused by rotation of the fan blades of the wind wheel 3 continuously and periodically impacts the volute tongue 2, the volute 1 and other air duct bodies, such that the peak value of the rotating noise is increased. The larger the non-uniformity of the airflow is, the stronger the noise is. When the dislocation is too large, the cross-flow continuity in the wind wheel 3 will be damaged, and an obvious left-right deviation wind feeling will be generated, which will influence the air volume and the air supply effect of the air duct. Therefore, according to the embodiment, by defining the dislocation angle between the first air outlet area and the second air outlet area, the air outlet width can be expanded, the air supply range can be enlarged, meanwhile, noise is not increased, and the air volume of the air duct is not affected.

Specifically, in one embodiment, $\theta$ is 40°. In some alternative embodiments, $\theta$ is 20° or 30°.

On the basis of the above embodiments, in some embodiments, a central symmetry plane of the second side of the first body 101 and the second side of the second body 201 is defined as a dislocation reference planes 5, the first plane 6 and the second plane 7 are respectively located on two opposite sides of the dislocation reference plane 5, an included angle between the first plane 6 and the dislocation reference plane 5 is $\theta 1$, an included angle between the second plane 7 and the dislocation reference plane 5 is $\theta 2$, $0<\theta 1\leq 20°$, and $0<\theta 2\leq 20°$. As an alternative embodiment, $0<\theta 1\leq 20°$, $\theta 2$ is greater than 20°; or $\theta 1$ is greater than 20°, $0<\theta 2\leq 20°$. Since the chord line of the cross-flow air duct volute 1 is spirally arranged, the fluid at the outlet of the cross-flow air duct volute 1 is sprayed out along the tangent line of the chord line of the original volute 1, so that the wind speed at the position, of the spiral line extension section, close to the back plate of the volute 1 is higher than the speed at the position, of the spiral line extension section, far from the volute 1. If the dislocation angle of the first air outlet area and the second air outlet area is too large, the air duct pressure gradient of the adjacent sections is increased, so that the air outlet speeds of the first air outlet area and the adjacent second air outlet area is not uniform, and meanwhile, the noise and the sound quality are also influenced. Therefore, according to the embodiment, the included angle between the first plane 6 and the staggered reference surface 5 and the included angle between the second plane 7 and the staggered reference surface 5 are limited, that is, the included angle between the center of the first air outlet area and the staggered reference surface 5 and the included angle between the center of the second air outlet area and the staggered reference surface 5 are limited, the situation that the air outlet speed of the adjacent first air outlet area and the second air outlet area is uneven can be avoided, meanwhile, noise will not be increased, and tone quality can be ensured.

On the basis of the above embodiments, in some embodiments, the first side of the first body 101 is provided with a plurality of third air deflectors 10 arranged at intervals along the axial direction of the volute 1. In this embodiment, the arrangement of the third air deflectors 104 can ensure the stability of the cross-flow air duct.

On the basis of the foregoing embodiment, in some embodiments, the first side of the second body 201 is provided with an air inlet guiding surface 204. In this embodiment, the air inlet guiding surface 204 cooperates with the volute 1, so that external air smoothly enters the cross-flow air duct. The air inlet guiding surface 204 is an inclined surface extending along the radial direction of the wind wheel 3.

The cross-flow air duct further includes an air outlet grille 4, the air outlet grille 4 is arranged at the air outlet port, the air outlet grille 4 includes a plurality of first grille sections 401 and a plurality of second grille sections 402 which are alternately arranged in the axial direction of the volute 1. Longitudinal center symmetrical planes of the first grille sections 401 are close to the second side of the first body 101, and longitudinal center symmetrical planes of the second grille sections 402 are close to the second side of the second body 201. It should be noted that the longitudinal central symmetry planes are coplanar with the axis of the wind wheel 3.

In this embodiment, the plurality of first grille sections 401 and the plurality of second grille sections 402 are arranged alternately, the longitudinal center symmetric planes of the first grille sections 401 are close to the second side of the first body 101, the longitudinal center symmetric planes of the second grille sections 402 are close to the second side of the second body 201, the first grille sections 401 are respectively arranged at the first air outlet openings, the second grille section 402 are respectively arranged at the second air outlet openings, the second side of the first body 101 is located on the left side, and the second side of the second body 201 is located on the right side. Therefore, the problem that the air supply range of an existing cross-flow air duct is narrow can be effectively solved, and wider-range air supply is achieved while it is guaranteed continuous upper and lower air-cutting of the cross-flow air duct of the tower fan, so that the wind feeling of the whole machine is improved, and the comfort experience of the user is improved.

On the basis of the above embodiments, in some embodiments, the longitudinal central symmetry plane of each first grille section 401 is defined as a first central symmetry plane 4011, the longitudinal central symmetry plane of each second grille section 402 is defined as a second central symmetry plane 4021, an included angle between the first central symmetry plane 4011 and the second central symmetry plane 4021 being $\beta$, and $0<\beta\leq 50°$. The included angle between the first central symmetry plane 4011 and the second central symmetry plane 4021 is the dislocation angle of the first grille section 401 and the second grille section 402, and if the dislocation angle of the first grille section 401 and the second grille section 402 is too large, the noise and the air volume are abnormal, so that the embodiment defines the dislocation angle of the first grille section 401 and the second grille section 402, which will not increase the noise and but ensure the air volume on the premise of ensuring the air supply range.

On the basis of the foregoing embodiments, in some embodiments, a central symmetry plane of the second side of the first body 101 and the second side of the second body 201 is defined as a dislocation reference plane 5, the included angle between the first central symmetric plane 4011 and the dislocation reference plane 5 is $\beta 1$, the included angle between the second central symmetric plane 4021 and the staggered reference plane 5 is $\beta 2$, $0<\beta 1\leq 25°$, and $0<\beta 2\leq 25°$. As a convertible embodiment, $0<\beta 1\leq 25°$, $\beta 2$ is greater than 25°; or $0<\beta 2\leq 25°$, and $\beta 1$ is greater than 25°. In this embodiment, the included angle between the first central symmetric plane 4011 and the staggered reference plane 5 is the angle that the first grille section 401 deflects leftwards, and the included angle between the second central symmetry plane 4021 and the staggered reference plane 5 is the angle that the second grille section 402 deflects rightwards. According to the embodiment, the deflection angles of the first grille section 401 and the second grille section 402 are further defined, so that noise cannot be increased on the premise of ensuring the air supply range, and the air volume is ensured.

On the basis of the above embodiments, in some embodiments, a length of each first grille section 401 is C, and/or a length of each second grille section 402 is C, and $1D/9\leq C\leq 1D/4$. If the length of the first grille section 401 and the second grille section 402 is too short, the air guide effect thereof is weakened, meanwhile, the air pressure of the outlet is insufficient, the wind speed is reduced, and the air supply effect of the air duct is affected; if the length of the first grille section 401 and the length of the second grille section 402 are too long, dynamic and static interference between the grille and the air supply fluid is increased, resulting in an increase in noise peak value. Therefore, according to the embodiment, the lengths of the first grille section 401 and the second grille section 402 are limited, and the noise will be not increased while the air supply effect is ensured. It should be noted that the length of the first grille section 401 and the length of the second grille section 402 are sizes thereof along the direction in which air flows out.

In one embodiment, the length of the first grille section 401 and the length of the second grille section 402 are equal. In other alternative embodiments, the length of the first grille section 401 and the length of the second grille section 402 are not equal.

On the basis of the foregoing embodiments, in some embodiments, the cross-flow air duct further includes a wind wheel 3 disposed in the mounting space, the diameter of the wind wheel 3 is D. In this embodiment, the volute 1, the volute tongue 2, the wind wheel 3, and the air outlet grille 4 together form the cross-flow air duct.

On the basis of the above embodiments, in some embodiments, the cross section of the second body 201 is a circular arc, and an axis of the second body 201 is collinear with an axis of the wind wheel 3. In this embodiment, the volute tongue 2 can better guide the airflow to play the role of a diversion cone.

On the basis of the foregoing embodiments, in some embodiments, a radial minimum distance between the second body 201 and the wind wheel 3 is A, and $1D/28 \leq A \leq 1D/10$. The radial distance between the second body 201 and the wind wheel 3 is the gap between the volute tongue 2 and the wind wheel 3. The ratio of the gap between the volute tongue 2 and the wind wheel 3 to the diameter of the wind wheel 3 significantly affects the flow and efficiency, and provides a certain influence on the pressure of the cross-flow air duct. When the gap is large, the pressure of the fan is reduced, the flow is reduced; when the gap is reduced, the pressure is increased, the flow is increased, but the noise peak value and the sound quality also become poor, and the subsequent cross-flow air duct rotation and distribution, production compliance of the wind wheel 3 can be affected. Therefore, according to the embodiment, the radial minimum distance between the second body 201 and the wind wheel 3 is limited, so that it can be ensured that certain pressure and flow are achieved, noise is not increased, and tone quality is not affected.

On the basis of the foregoing embodiments, in some embodiments, a volute throat 105 is provided at a position where a distance between the first body 101 and the wind wheel 3 is the smallest, a distance between the volute throat 105 and the wind wheel 3 is B, and $1D/22 \leq B \leq 1D/11$.

The increase of the distance between the wind wheel 3 and the volute 1 causes the air volume to decrease, and causes the vortex area at the first side of the volute 1 to gradually increase, so that the flow guide turbulence noise is increased. If the distance between the volute throat 105 and the wind wheel 3 is too small, the non-uniformity of the wind speed and pressure in the airflow in the wind wheel 3 is increased, the pulse power of the area around the volute 1 is increased, so that the rotation noise is increased. Therefore, according to the embodiment, the distance between the volute throat 105 and the wind wheel 3 is limited, the uniformity of the wind speed and the pressure in the wind wheel 3 can be ensured, and the noise is reduced.

On the basis of the above embodiments, in some embodiments, a radial distance between the air outlet grille 4 and the wind wheel 3 is F, and $1D/6 \leq F \leq 1D/3$. If the distance between the air outlet grille 4 and the wind wheel 3 is too small, the pressure pulsation of at the outlet of the air passage is increased, thereby increasing the broadband noise in the flow field. Therefore, according to the embodiment, the radial distance between the air outlet grille 4 and the wind wheel 3 is limited, such that large noise of the air duct outlet is prevented, the air volume loss is reduced, and the size of the outlet wind speed is ensured.

Figure 2:
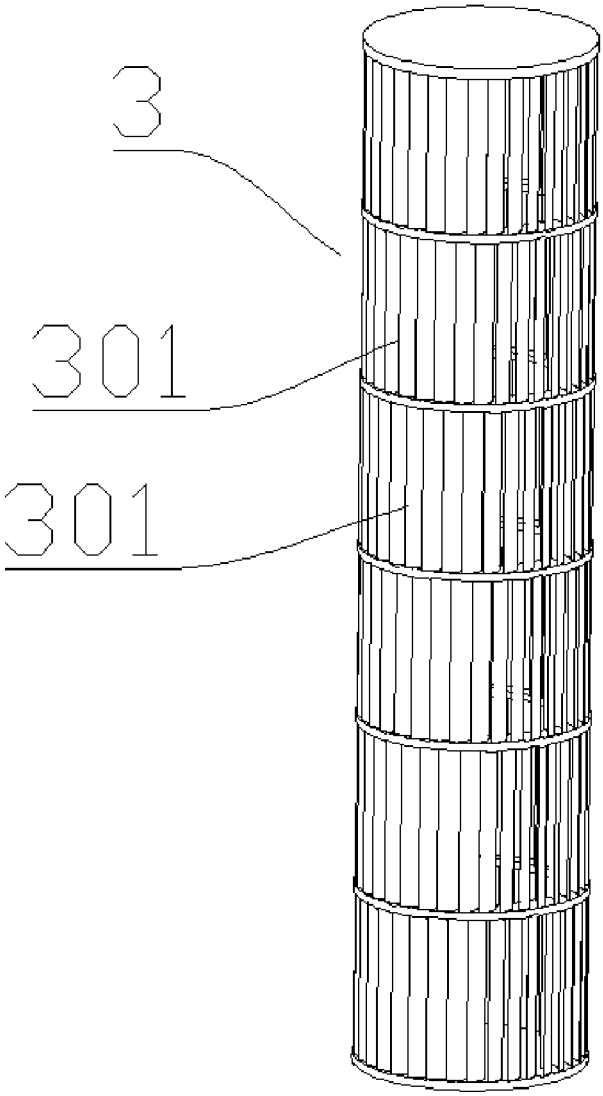
FIG. 2 is a schematic structural diagram of a fan wheel shown FIG. 1.
Figure 3:
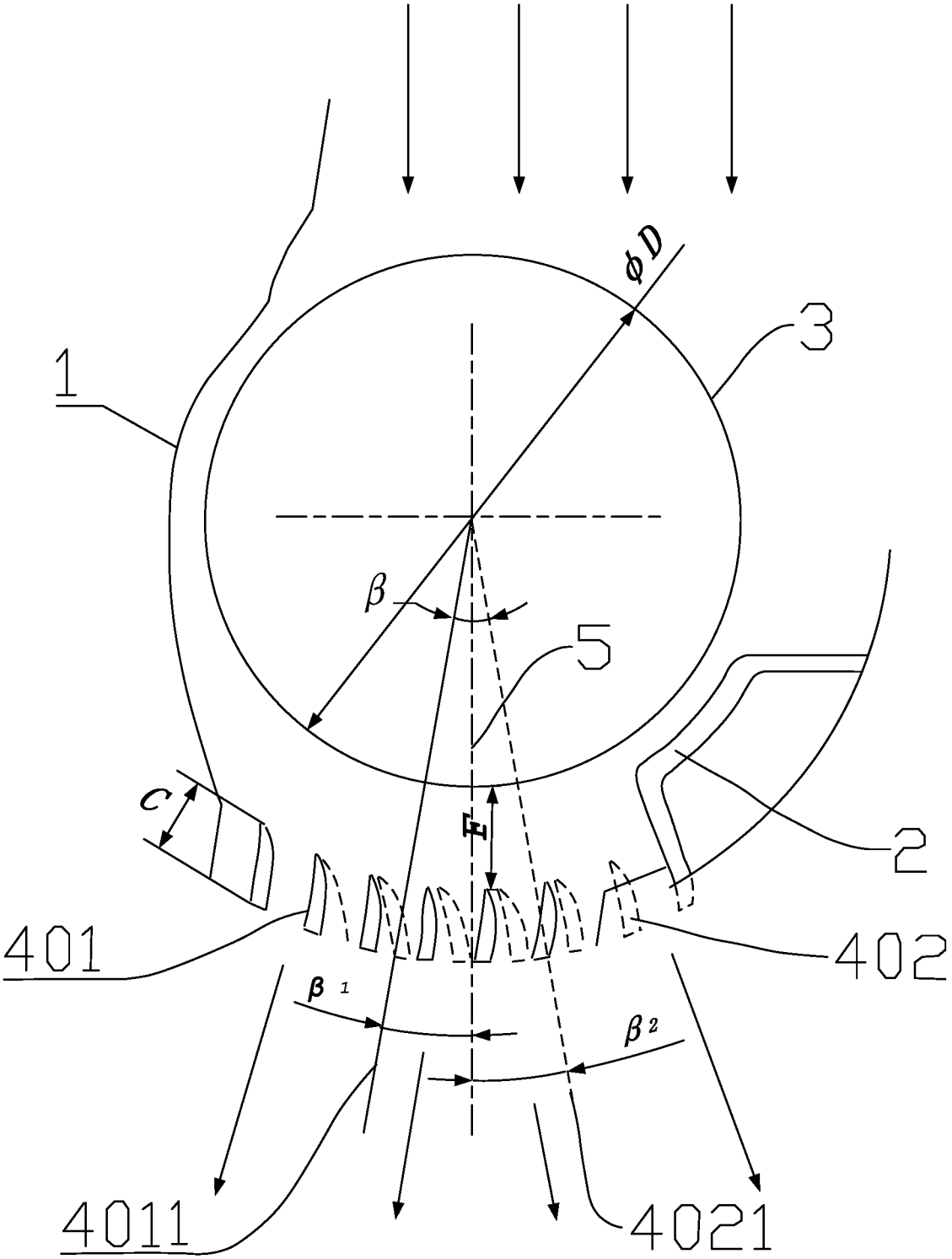
FIG. 3 is a top view of the cross-flow air duct shown in FIG. 1.
Figure 4:
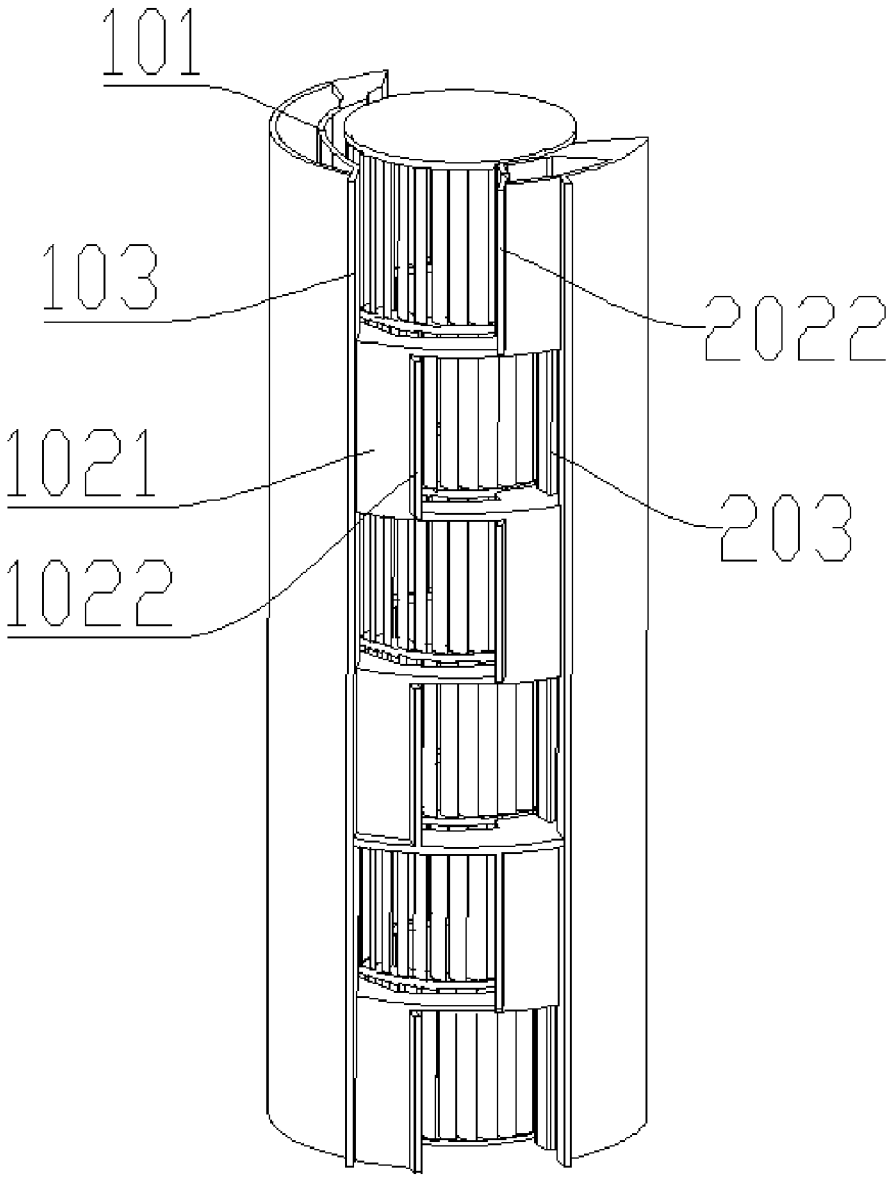
FIG. 4 is a schematic structural diagram illustrating the cross-flow air duct, shown in FIG. 1, without an air outlet grille.
Figure 5:
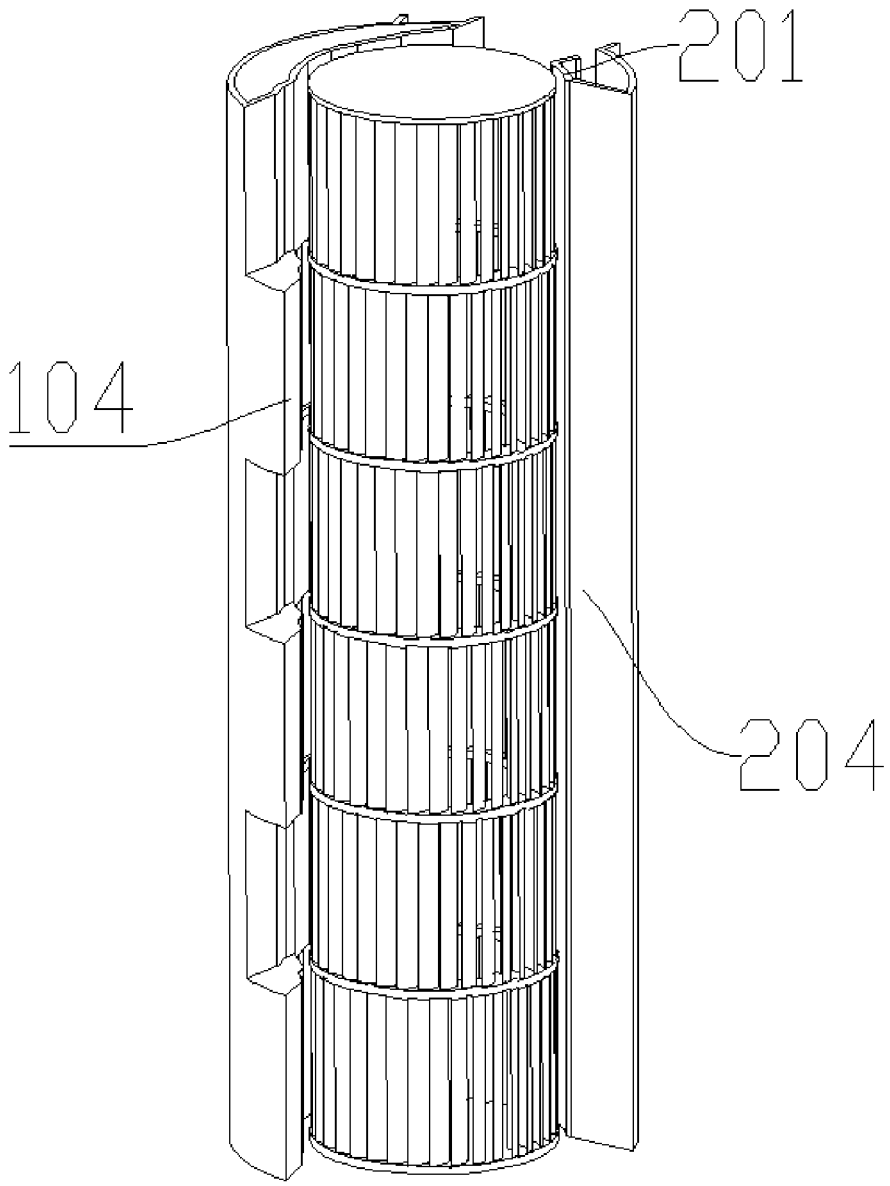
FIG. 5 is a schematic structural diagram illustrating an air inlet side of the cross-flow air duct shown in FIG. 4.
Figure 6:
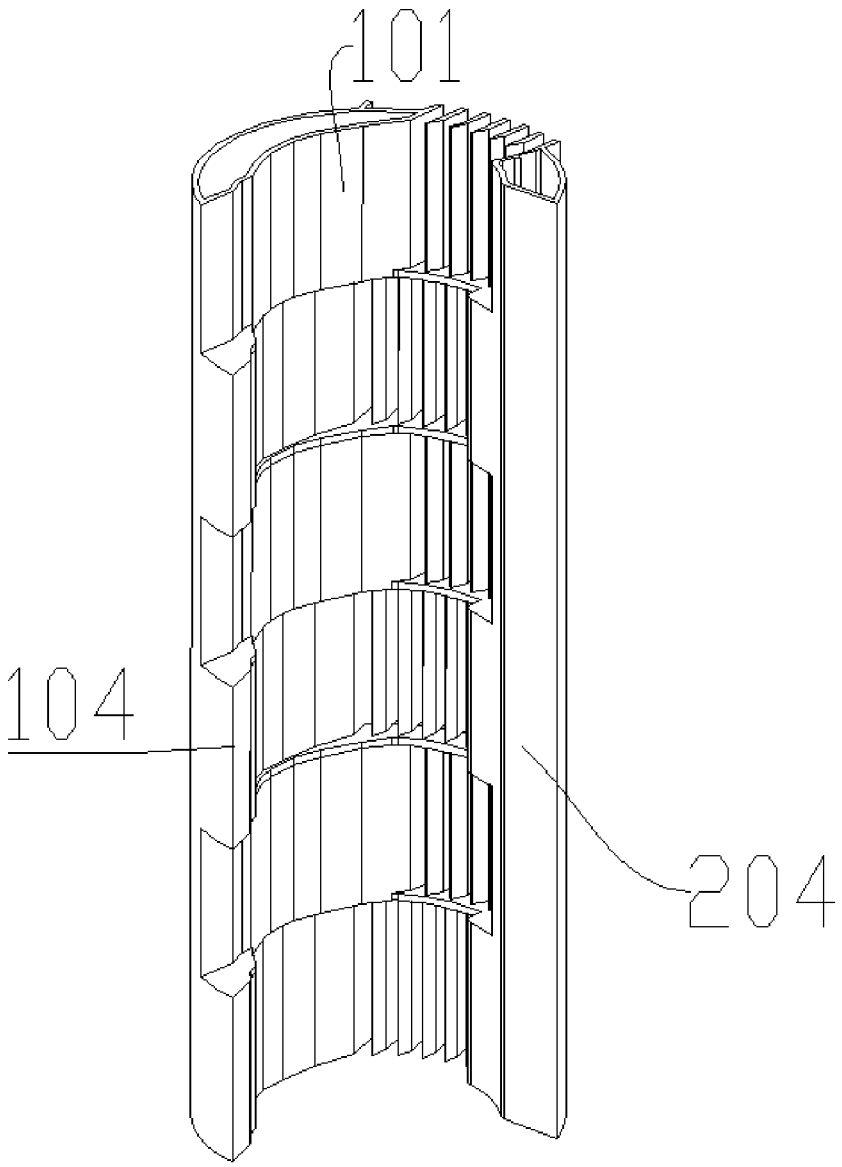
FIG. 6 is a schematic structural diagram illustrating the cross-flow air duct, shown in FIG. 5, without a fan wheel.
Figure 7:
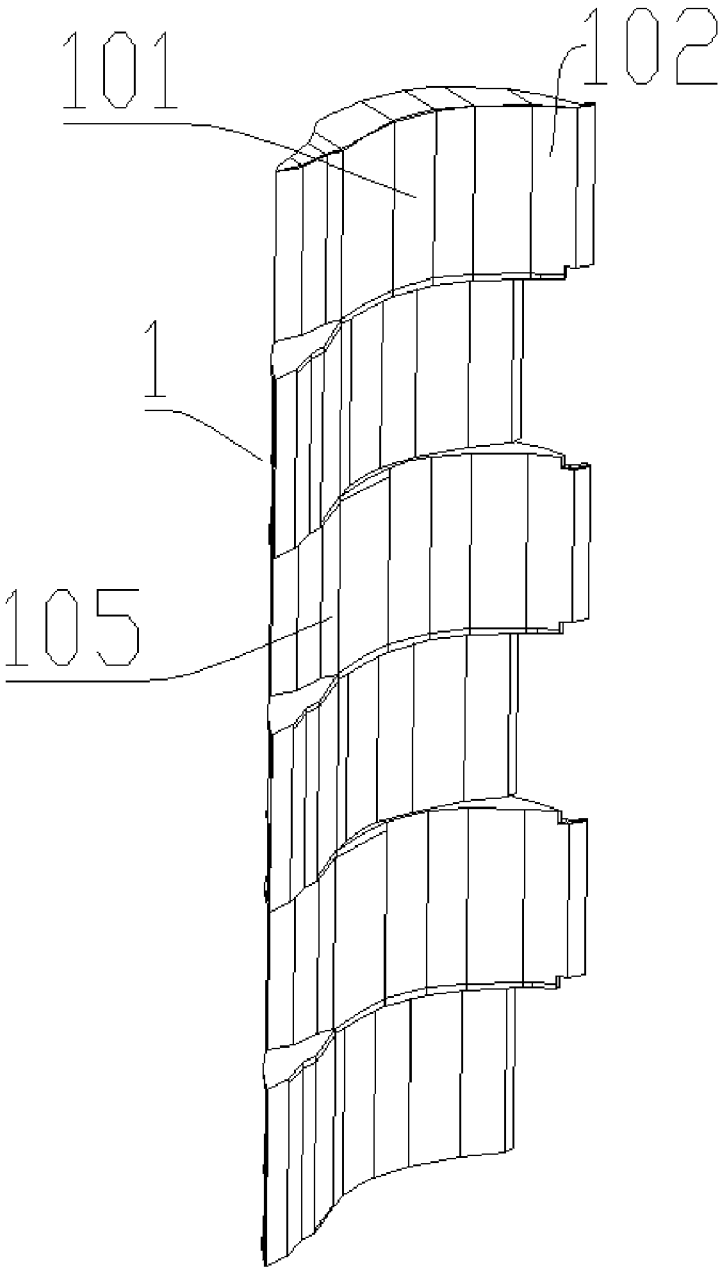
FIG. 7 is a schematic structural diagram of a volute of the cross-flow air duct shown in FIG. 1.
Figure 8:
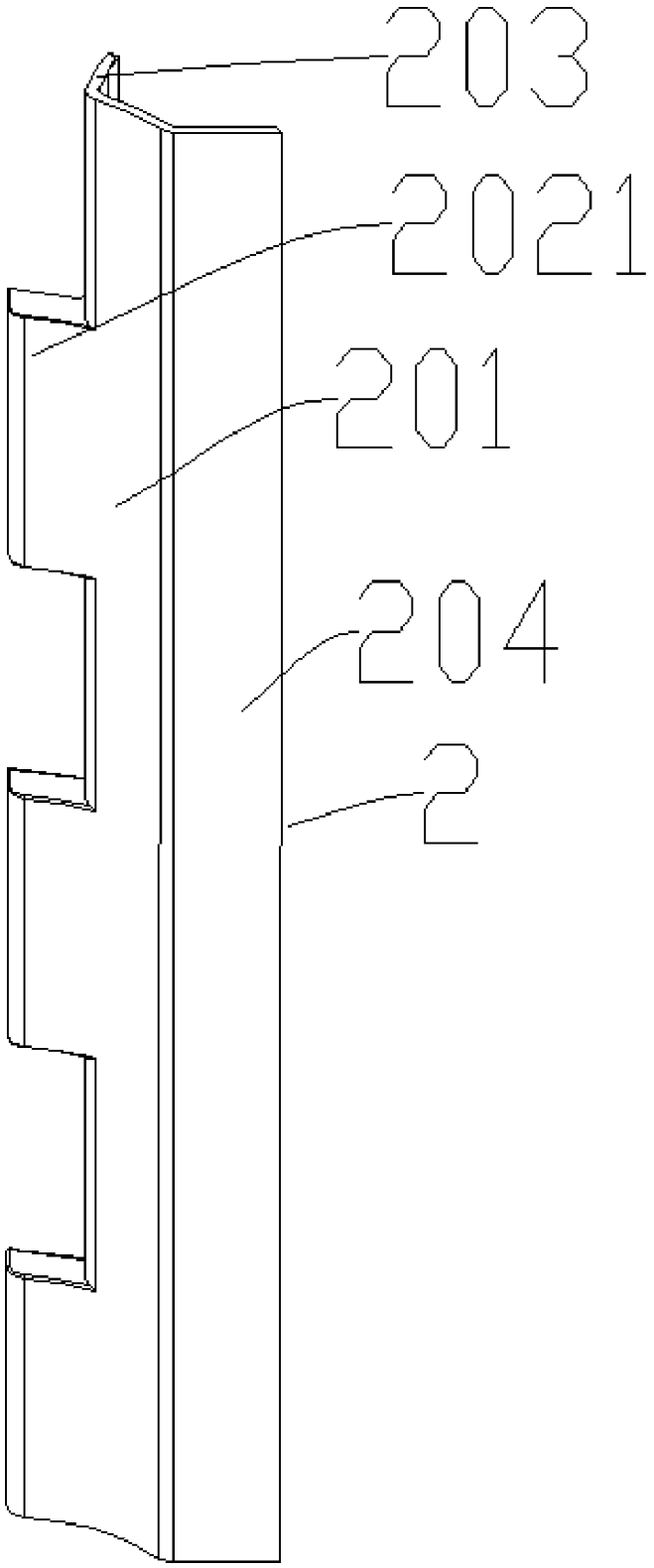
FIG. 8 is a schematic structural diagram of a volute tongue, of the cross-flow air duct shown in FIG. 1, taken along a view angle.
Figure 9:
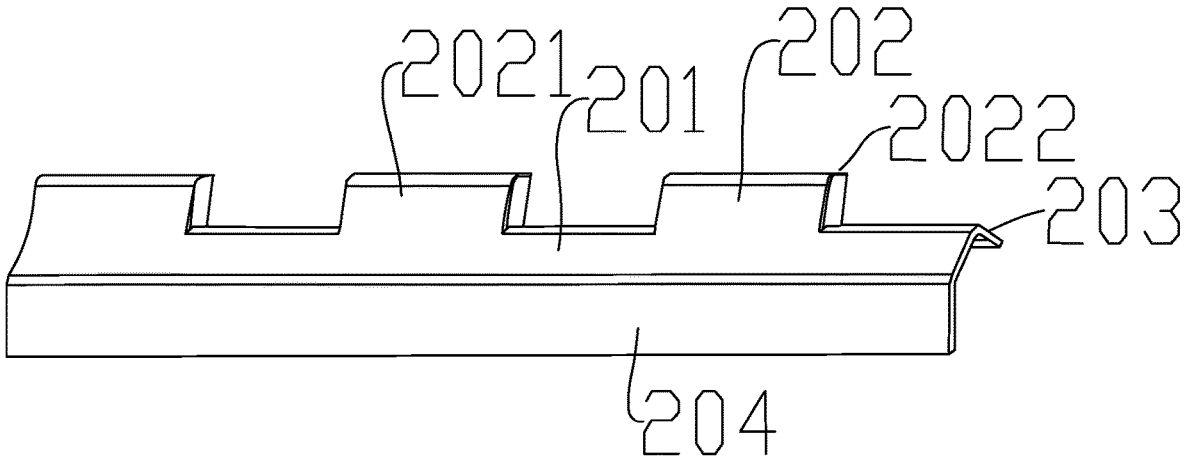
FIG. 9 is a schematic structural diagram of the volute tongue, shown in FIG. 8, taken along another view angle.

On the basis of the above embodiments, in some embodiments, as shown in FIG. 2, the wind wheel 3 includes a plurality of wind wheel sections 301. A distance between any two adjacent first grille sections 401, or a distance between any two adjacent second grille sections 402, or a distance between any two adjacent first air deflector 102, or a distance between any two adjacent second air deflector 202 is N times a length of one section wind wheel section 301, and $1 \leq N \leq 3$.

The distance between two adjacent first grille sections 401 is the height of the second grille section 402, and the distance between two adjacent second grille sections 402 is the height of the first grille section 401. According to the embodiment, the height of the first grille section 401 and the height of the second grille section 402 are limited, that is, the grille discrete dislocation frequency is limited. As the volute 1 and the volute tongue 2 act on the cross-flow air duct, vortexes can be formed in the flow field of the wind wheel 3, and when the vortex deviates from the center of the rotation axis of the impeller, the cross-flow is generated. If the heights of the first grille section 401 and the height of the second grille section 402 are too low, the discrete frequency of the flow field at the outlet is increased, the air pressure in the air duct is affected, the eccentric vortex position of the single section cannot be stable, a stable cross-flow area cannot be formed in the impeller, the flow field between the adjacent sections is disordered, and the noise, the sound quality, the outlet wind speed and the flow of the whole machine can be greatly influenced. If the heights of the first grille section 401 and the height of the second grille section 402 are too large, the dislocation amplitude of the flow field is increased, the staggered air supply of the adjacent sections of air ducts cannot be converged at a far position, an obvious left-right deviation wind feeling is generated, and the user experience is influenced. Therefore, according to the embodiment, the height of the first grille section 401 and the height of the second grille section 402 are limited, it can be ensured that a stable cross-flow area is formed in the impeller, the noise, the sound quality, the outlet wind speed and the flow of the whole machine will not be affected, and the left wind speed and the right wind speed are uniform.

The present embodiments provide an air outlet device. The air outlet device may specifically be a fan structure, or may be other air outlet device such as an air conditioner or an air cooler. The air outlet device includes the cross-flow air duct provided in the above embodiments.

Obviously, the above-mentioned embodiments are merely examples which are clearly illustrated, and are not limited to the embodiments. For a person having ordinary skill in the art, other different forms of changes or variations can be made on the basis of the above description. It is not necessary and impossible to exhaustively list all implementation methods here. It will be apparent from this disclosure that variations or variations are still within the scope of protection created by the present disclosure.

What is claimed is:

1. A cross-flow air duct, comprising: a volute, the volute comprising a first body, a first side of the first body being an air inlet side, and a second side of the first body being an air outlet side; and a volute tongue, the volute tongue and the volute being arranged at an interval, the volute tongue comprising a second body, a first side of the second body being an air inlet side, a second side of the second body being an air outlet side, a mounting space suitable for mounting a fan wheel being formed between the first body and the second body, an air inlet port being formed between the first side of the first body and the first side of the second body, and an air outlet port being formed between the second side of the first body and the second side of the second body; wherein the air outlet port comprises a plurality of first air outlet openings and a plurality of second air outlet openings, and the plurality of first air outlet openings and the plurality of second air outlet openings are alternately arranged at intervals along an axial direction of the volute; wherein a plurality of first air deflectors are arranged at intervals along the axial direction of the volute on the second side of the first body, each first air outlet opening is formed between a corresponding first air deflector and the second body; and a plurality of second air deflectors are arranged at intervals along the axial direction of the volute in the second side of the second body, each second air outlet opening is formed between a corresponding second air deflector and the first body; the plurality of first air deflectors and the plurality of second air deflectors are alternately arranged along the axial direction of the volute.

2. The cross-flow air duct according to claim 1, wherein each first air deflector comprises a first plate body and a first air guide surface disposed at an end of the first plate body and extending toward an outer side of the mounting space, the second side of the first body is further provided with a second air guide surface, and the second air guide surface extends toward the outer side of the mounting space; and each second air deflector comprises a second plate body and a third air guide surface disposed at an end of the second plate body and extending toward the outer side of the mounting space, the second side of the second body is further provided with a fourth air guide surface, and the fourth air guide surface extends toward the outer side of the mounting space.

3. The cross-flow air duct according to claim 2, wherein a central symmetry plane of the first air guide surface and the second air guide surface is defined as a first plane, a central symmetry plane of the third air guide surface and the fourth air guide surface is defined as a second plane, an included angle between the first plane and the second plane is $\theta$, and $0<\theta\leq 40°$.

4. The cross-flow air duct according to claim 3, wherein a central symmetry plane of the second side of the first body and the second side of the second body is defined as a dislocation reference plane, the first plane and the second plane are respectively located on two opposite sides of the dislocation reference plane, an included angle between the first plane and the dislocation reference plane is $\theta 1$, and $0<\theta 1\leq 20°$.

5. The cross-flow air duct according to claim 3, wherein a central symmetry plane of the second side of the first body and the second side of the second body is defined as a dislocation reference plane, the first plane and the second plane are respectively located on two opposite sides of the dislocation reference plane, an included angle between the second plane and the dislocation reference plane is $\theta 2$, and $0<\theta 2\leq 20°$.

6. The cross-flow air duct according to claim 3, wherein a central symmetry plane of the second side of the first body and the second side of the second body is defined as a dislocation reference plane, the first plane and the second plane are respectively located on two opposite sides of the dislocation reference plane, an included angle between the first plane and the dislocation reference plane is $\theta 1$, an included angle between the second plane and the dislocation reference plane is $\theta 2$, $0<\theta 1\leq 20°$, and $0<\theta 2\leq 20°$.

7. The cross-flow air duct according to claim 1, wherein a plurality of third air deflectors are arranged at intervals along the axial direction of the volute on the first side of the first body.

8. The cross-flow air duct according to claim 1, wherein an air inlet guiding surface is provided on the first side of the second body.

9. The cross-flow air duct according to claim 1, wherein the cross-flow air duct further comprises an air outlet grille arranged at the air outlet port, the air outlet grille comprises a plurality of first grille sections and a plurality of second grille sections alternately arranged along the axial direction of the volute, the plurality of first grille sections are respectively arranged at the plurality of first air outlet openings, the plurality of second grille sections are respectively arranged at the plurality of second air outlet openings, a longitudinal central symmetry plane of each first grille section is close to the second side of the first body, and a longitudinal central symmetry plane of each second grille section is close to the second side of the second body.

10. The cross-flow air duct according to claim 9, wherein the longitudinal central symmetry plane of the first grille section is defined as a first central symmetry plane, the longitudinal central symmetry plane of the second grille section is defined as a second central symmetry plane, an included angle between the first central symmetry plane and the second central symmetry plane is $\beta$, and $0<\beta\leq 50°$.

11. The cross-flow air duct according to claim 10, wherein a central symmetry plane of the second side of the first body and the second side of the second body is defined as a dislocation reference plane, an included angle between the first central symmetry plane and the dislocation reference plane is $\beta 1$, and $0<\beta 1\leq 25°$.

12. The cross-flow air duct according to claim 10, wherein a central symmetry plane of the second side of the first body and the second side of the second body is defined as a dislocation reference plane, an included angle between the second central symmetry plane and the dislocation reference plane is $\beta 2$, and $0<\beta 2\leq 25°$.

13. The cross-flow air duct according to claim 10, wherein a central symmetry plane of the second side of the first body and the second side of the second body is defined as a dislocation reference plane, an included angle between the first central symmetry plane and the dislocation reference plane is $\beta 1$, an included angle between the second central symmetry plane and the dislocation reference plane is $\beta 2$, $0<\beta 1\leq 25°$, and $0<\beta 2\leq 25°$.

14. The cross-flow air duct according to claim 1, wherein a cross section of the second body is a circular arc, and an axis of the second body is collinear with an axis of the fan wheel.

15. The cross-flow air duct according to claim 14, wherein a radial minimum distance between the second body and the fan wheel is A, a diameter of the fan wheel is D, and $1D/28\leq A\leq 1D/10$.

16. The cross-flow air duct according to claim 1, wherein a volute throat is provided at a position where a distance between the first body and the fan wheel is the smallest, a distance between the volute throat and the fan wheel is B, a diameter of the fan wheel is D, and $1D/22\leq B\leq 1D/11$.

17. The cross-flow air duct according to claim 9, wherein a length of each first grille section is C, and/or a length of each second grille section is C, a diameter of the fan wheel is D, and $1D/9\leq C\leq 1D/4$.

18. The cross-flow air duct according to claim 9, wherein a radial distance between the air outlet grille and the fan wheel is F, a diameter of the fan wheel is D, and $1D/6\leq F\leq 1D/3$.

19. The cross-flow air duct according to claim 9, wherein the fan wheel comprises a plurality of fan wheel sections, a distance between any two adjacent first air deflector, or any two adjacent second air deflector, or any two adjacent first grille sections, or any two adjacent second grille section sections is N times a length of one fan wheel section, and $1\leq N\leq 3$.

20. An air outlet device comprising the cross-flow air duct according to claim 1.

* * * * *